US007648230B2

(12) United States Patent
Kachi

(10) Patent No.: US 7,648,230 B2
(45) Date of Patent: Jan. 19, 2010

(54) INK SUPPLY DEVICE, INK JET RECORDING APPARATUS AND INK CARTRIDGE

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 555 days.

(21) Appl. No.: 11/504,036

(22) Filed: Aug. 15, 2006

(65) Prior Publication Data

US 2007/0040877 A1 Feb. 22, 2007

(30) Foreign Application Priority Data

Aug. 16, 2005 (JP) ..... 2005-235985

(51) Int. Cl.
*B41J 2/175* (2006.01)

(52) U.S. Cl. ..... 347/85

(58) Field of Classification Search ..... 347/5, 347/7, 14, 19, 84, 85
See application file for complete search history.

(56) References Cited

U.S. PATENT DOCUMENTS 5,187,498 A * 2/1993 Burger ..... 347/86
5,617,122 A * 4/1997 Numata et al. ..... 347/14
6,315,402 B1 * 11/2001 Kawase ..... 347/85
7,077,513 B2 * 7/2006 Kimura et al. ..... 347/85
7,290,849 B2 * 11/2007 Yamazaki et al. ..... 347/19
7,325,908 B2 * 2/2008 Katoh et al. ..... 347/85

FOREIGN PATENT DOCUMENTS

JP 63-147651 A 6/1988
JP 2003-300331 A 10/2003

* cited by examiner

*Primary Examiner*—Anh T. N. Vo
(74) *Attorney, Agent, or Firm*—Birch, Stewart, Kolasch & Birch, LLP

(57) ABSTRACT

An ink cartridge consists of an ink bag storing ink and a case holding the ink bag. A valve unit is placed on an ink supply path from the ink bag to a recording head. During the printing, the amount of ink discharged from the recording head is measured at predetermined time intervals, and the valve unit is controlled to supply the recording head with the ink by an amount corresponding to the discharged amount. So the pressure inside the recording head is kept approximately constant, improving stability of ink-discharging from nozzles of the recording head. A head internal pressure detecting mechanism detects pressure inside a sub-tank as a value representative of the head internal pressure.

20 Claims, 13 Drawing Sheets

INK SUPPLY DEVICE, INK JET RECORDING APPARATUS AND INK CARTRIDGE

FIELD OF THE INVENTION

The present invention relates to an ink supply device for supplying ink to an ink jet type recording head. The present invention relates also to an ink jet recording apparatus using the ink supply device, and an ink cartridge removably mounted in the ink jet recording apparatus, such that the ink is supplied from the ink cartridge to the recording head through the ink supply device.

BACKGROUND ARTS

An ink jet recording apparatus has been known, which has a recording head for discharging ink as droplets onto a recording paper to print an image. The ink jet recording apparatus is provided with at least an ink container containing ink, to supply the ink from the ink container to the recording head. In an example, the recording head is provided with at least a nozzle and an oscillation plate driven by a piezoelectric element. Making use of pressure change in the nozzle, which is caused by oscillating the oscillation plate, the ink is supplied from the ink container into the nozzle of the recording head, and the ink is discharged through an ink outlet of the nozzle.

Because the ink is a consumable material, the ink container is often formed as a cartridge that is removably attached to the ink jet recording apparatus, so the ink may be supplied conveniently. When the ink contained in the cartridge type ink container, hereinafter called the ink cartridge, is used up, the empty ink cartridge is replaced with another that is fully filled with the ink. An ink supply path is provided between an ink cartridge loading section of the recording apparatus and the recording head, so that the ink is supplied from the ink cartridge to the recording head through the ink supply path.

An ink jet recording apparatus using an ink cartridge that consists of a flexible ink bag and a case protecting the ink bag has been known, for example, from Japanese laid-open Patent Application No. 2003-300331. If the ink is exposed to air, the air will be dissolved in the ink, forming air bubbles in the ink, or some components of the ink react with oxygen, deteriorating the ink. To keep the air out of the ink, the ink cartridge uses the air-tight ink bag.

It is known in the art that the pressure inside the recording head, hereinafter called the head internal pressure, is kept negative relative to the atmosphere, in order to prevent leakage of the ink through the nozzle, which would otherwise be caused by the weight of the ink. Where the ink cartridge is placed above the recording head, the head internal pressure is so raised by the weight of the ink contained in the ink cartridge, that it cannot keep the negative value relative the atmospheric pressure without any countermeasure.

In order to block the positive pressure due to the ink weight from the nozzle, it has been suggested providing a valve mechanism for opening and closing the ink supply path between the ink cartridge and the recording head, for example, from Japanese Laid-open Patent Application No. SHO 63-147651. The valve mechanism is controlled to open the ink supply path only while the recording head is activated. According to this prior art, the positive pressure due the ink weight is blocked while the recording head is inactive, so the ink leakage from the recording head is prevented.

However, because the above prior art keeps the ink supply path open during the recording, there remain some concerns about stability of ink-discharging and ink leakage during the recording. The pressure due to the ink weight varies with consumption and thus reduction of the ink contained in the ink cartridge, whereas the head internal pressure varies with the discharged amount of ink. So the head internal pressure cannot exactly be kept negative without adjusting the amount of the ink to be supplied to the recording head in accordance with the variations in the positive pressure due to the ink weight and the variations in the head internal pressure.

SUMMARY OF THE INVENTION

In view of the foregoing, a primary object of the present invention is to provide an ink supply device for supplying ink from an ink container, which contains the ink in an ink bag, to a recording head of an ink jet recording apparatus, so that the ink supply device ensures stability of ink-discharging from the recording head and prevents ink leakage from the recording head during the recording.

Another object of the present invention is to provide an ink jet recording apparatus using the ink supply device of the present invention, and an ink cartridge using the ink supply device.

To achieve the above and other objects, an ink supply device of the present invention comprises an ink container consisting of an ink bag storing the ink and a case for holding the ink bag, the ink container being placed above the recording head; an ink supply amount adjusting device for adjusting the amount of ink supplied to the recording head, the ink supply amount adjusting device being placed on an ink supply path from the ink bag to the recording head; a discharged amount measuring device for measuring the amount of ink discharged from the recording head; and a controller for controlling the ink supply amount adjusting device so as to supply the recording head with the ink by an amount corresponding to the discharged amount of ink as measured by the discharged amount measuring device.

The controller preferably comprises an ink level calculator for calculating an ink level in the ink bag based on the discharged ink amount, and a flow rate calculator for calculating based on the calculated ink level a flow rate per unit time of the ink through the ink supply path, to control the ink supply amount adjusting device based on the flow rate.

The discharged amount measuring device may measure the discharged ink amount by counting the number of ink ejections from the recording head or by estimation based on the image data.

The ink supply amount adjusting device may be a valve unit that opens or closes the ink supply path, or a pump that sucks the ink out of the ink bag and sends the ink forcibly to the recording head.

The present invention further suggests an ink supply device that comprises an ink container consisting of an ink bag storing the ink and a case for holding the ink bag, the ink container being placed above the recording head; an ink supply amount adjusting device for adjusting the amount of ink supplied to the recording head, the ink supply amount adjusting device being placed on an ink supply path from the ink bag to the recording head; a head internal pressure measuring device for measuring pressure inside the recording head; and a controller for controlling the ink supply amount adjusting device in accordance with the pressure measured by the head internal pressure measuring device.

According to a preferred embodiment, the ink supply device further comprises a sub-tank placed on the ink supply path between the ink supply amount adjusting device and the recording head, wherein the sub-tank has a storage section for storing the ink temporarily on the way to the recording head, and is made at least partly of an elastic member that can deform elastically such that the storage section changes its volume as the pressure inside the recording head varies. The head internal pressure measuring device is a mechanism for detecting based on the degree of deformation of the elastic member whether the pressure inside the recording head is at a set value or not.

An ink jet recording apparatus of the present invention is characterized by comprising the ink supply device configured as above.

An ink cartridge of the present invention comprises a cartridge body consisting of an ink bag storing the ink and a case for holding the ink bag, the cartridge body being placed above the recording head; and an ink supply amount adjusting device for adjusting the amount of ink supplied to the recording head, the ink supply amount adjusting device being placed on an ink supply path from the cartridge body to the recording head.

The ink bag preferably has accordion folds that extend substantially horizontally, so that the ink bag is folded down along the accordion folds as the ink in the ink bag decreases The ink supply amount adjusting device may be a valve unit that opens or closes the ink supply path or a pump that sucks the ink out of the ink bag and sends the ink forcibly to the recording head.

Because the ink supply amount adjusting device is controlled to supply the recording head with the ink by an amount corresponding to the discharged ink amount, the pressure inside the recording head is kept approximately constant, so the stability of ink-discharging operation of the recording head is improved, while preventing leakage of the ink during the printing.

The same effect is obtained by measuring the pressure inside the recording head and controlling the ink supply amount adjusting device in accordance with the measured pressure.

BRIEF DESCRIPTION OF THE DRAWINGS

The above and other objects and advantages of the present invention will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
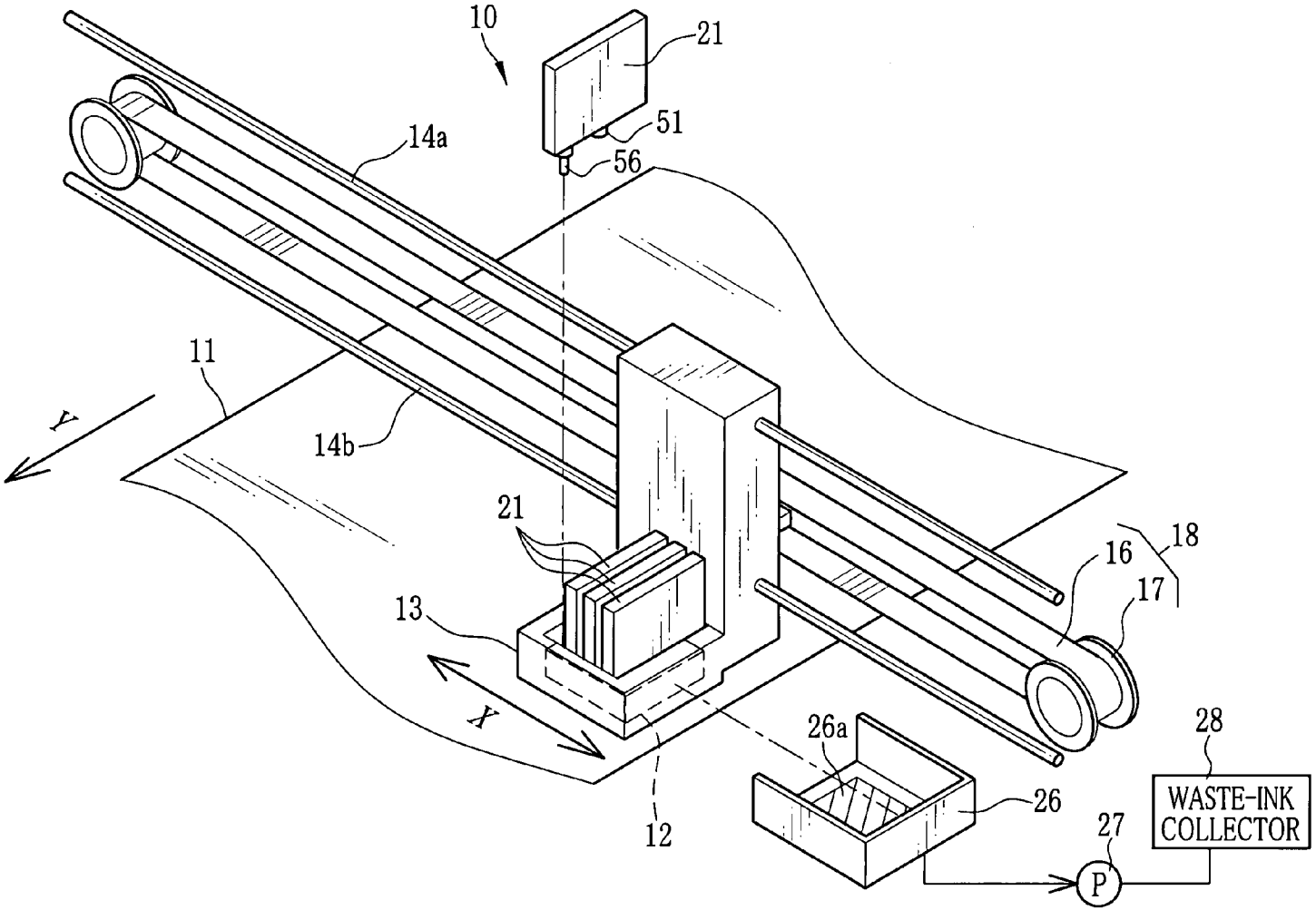
FIG. 1 is an explanatory diagram illustrating essential elements of an ink jet recording apparatus according to an embodiment of the invention.

An ink jet recording apparatus 10 shown in FIG. 1 is provided with a recording head 12 that discharges ink toward a recording medium, e.g. a paper sheet, 11 to print images thereon. The recording head 12 is provided with a plurality of nozzles 12*a* for discharging the ink from individual outlets. The outlets of the nozzles 12*a* are aligned in a plane to form a discharging surface, and the discharging surface is placed in face to a recording surface of the paper sheet 11. The recording head 12 is mounted in a carriage 13 that is movable in a widthwise direction of the paper sheet 11, that is, a main scanning direction X. The discharging surface is exposed through an opening formed through a bottom of the carriage 13. While reciprocating in the widthwise direction of the paper sheet 11 together with the carriage 13, the recording head 12 records an image in a line sequential fashion. Each time the recording head 12 makes one lap to record a line of the image, the recording paper 11 is fed by not-shown conveyer rollers in a sub scanning direction Y, which is orthogonal to the main scanning direction X, by a length corresponding to a width of each image line as recorded by the recording head 12. Thus, a frame of image is recorded line after line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 20, e.g. four cartridges containing inks of four different colors: yellow, magenta, cyan and black.

The carriage 13 is provided with not-shown slots, into which the ink cartridges 20 are plugged. In each slot, there is provided a connector portion that leads to the recording head 12. When the ink cartridge 20 is plugged in the slot, the connector portion is connected to the ink cartridge 20, establishing an ink supply path from the ink cartridge 20 to the recording head 12. The ink contained in the ink cartridge 20 is supplied through the ink supply path to the recording head 12. In the recording head 12, not-shown pressure rooms and oscillation plates are provided in one-to-one relationship with the respective nozzles 12*a*. The oscillation plates are driven individually by piezoelectric elements, to change volume of the pressure room. Thereby, the ink in the ink cartridge 20 is sucked into the nozzles 12*a*, and is ejected from the outlets of the nozzles 12*a*.

Figure 2:
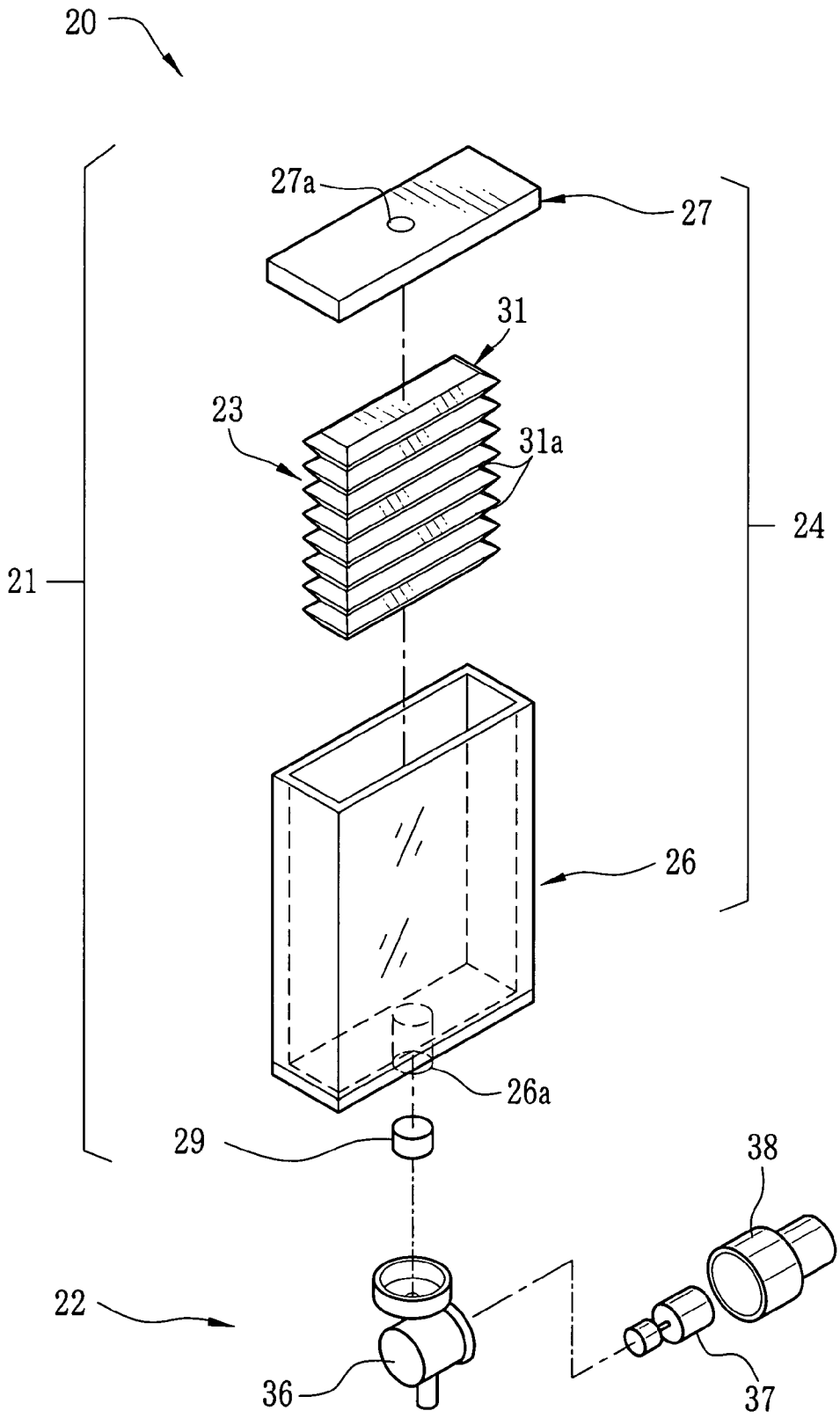
FIG. 2 is an exploded perspective view of an ink cartridge used in the ink jet recording apparatus of FIG. 1.

As shown in FIG. 2, the ink cartridge 20 consists of a cartridge body 21 containing the ink, and a valve unit 22. The cartridge body 21 consists of an ink bag 23 storing the ink, and a case 24 holding the ink bag 23. The case 24 consists of a case body 26 and a top lid 27 for closing an open top of the case body 26. After the case body 26 is filled with the ink, the top lid 27 is affixed to the case body 26, for example, by welding, so that the ink is prevented from leaking through the open top of the case body 26. The case body 26 is formed from a transparent plastic or the like, and protects the ink bag 23. The top lid 27 is provided with an air inlet 27*a* for letting the air into the case 24 as the ink bag 23 deflates with reduction of the ink contained therein. Since the ink is contained in the ink bag 23, the ink will not leak through the air inlet 27*a*.

An ink outlet 26*a* for feeding the ink out of the case body 26 is formed through a bottom of the case body 26. A filter 29 for filtering the ink is mounted in the ink outlet 26*a*. An upper end of the ink outlet 26*a*, which is located inside the case body 26, is joined to a not-shown ink spout of the ink bag 23, which is formed at a bottom position of the ink bag 23. A lower end of the ink outlet 26*a* is formed as a substantially cylindrical projection that protrudes from the bottom of the case body 26, so the valve unit 22 is mounted to the projection.

The ink bag 23 consists of a bag body 31 made of an air-tight material, so the ink bag 23 isolates the contained ink from the atmosphere, to keep the amount of air dissolved the ink at a low level. If the amount of air dissolved in the ink increases, air bubbles are generated in the ink, or the ink deteriorates due to chemical reaction on oxygen, causing defective discharging of the ink from the recording head 12. The ink bag 23 suppresses such troubles. Since the amount of air dissolved in the ink is kept low in the ink bag 23, the ink contained in the ink bag 23 is preserved in good condition for a longer time, so the ink cartridge 20 can contain a greater volume of ink. As an example of the air-tight material of the bag body 31, a surface-treated material made by depositing aluminum on a surface of a resin base is usable.

Figure 3A:
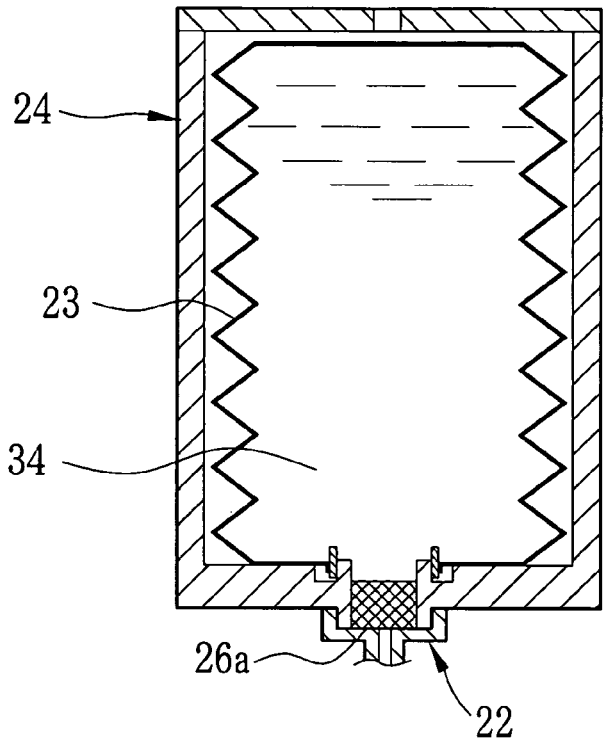
FIGS. 3A and 3B are sectional views of the ink cartridge.
Figure 3B:
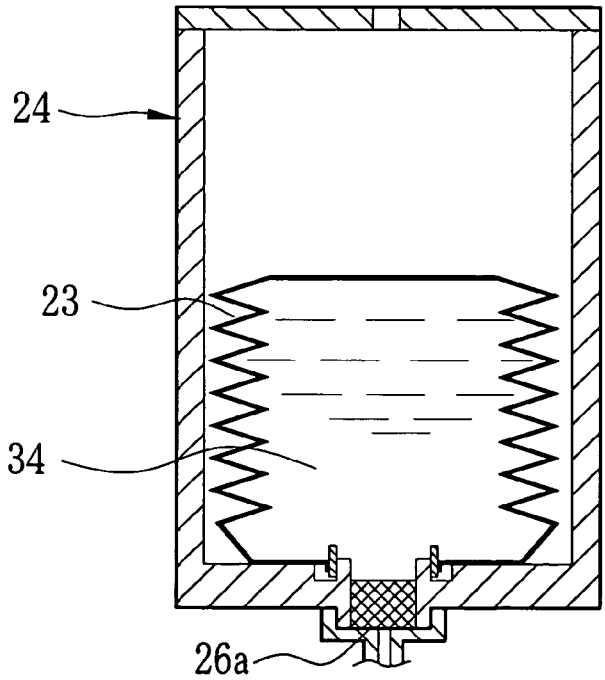

The material of the bag body 31 is also flexible, so it deflates as the contained ink decreases. The bag body 31 has accordion folds 31*a* with substantially horizontal folding lines. As being filled up with the ink 34, the ink bag 23 is in a state as shown in FIG. 3A. With the consumption of the contained ink 34, the ink bag 23 is folded along the accordion folds 31*a* to reduce its height while keeping its top surface approximately horizontal, as shown in FIG. 3B. Because the ink bag 23 will not irregularly deflate, the contained ink moves less with the deflation of the bag body 31, and the level of the liquid surface of the contained ink changes relatively continuously.

Because the weight of the ink in the ink bag 23 effects as a positive pressure on the head internal pressure, the continuous change in the ink level in the ink bag 23 makes the change in positive pressure applied to the recording head continuous. As a result, variations in the head internal pressure are suppressed, so the stability of ink discharging operation of the recording head 12 is improved. As will be described later, the opening time and the closing time of the valve unit 22 should be controlled considering the remaining amount of the ink, in order to supply the ink to the recording head 12 by an amount corresponding to the discharged amount of ink. Since the change in positive pressure, which results from the ink decrease in the ink bag 23, is made continuous, it becomes possible to control the valve unit appropriately.

Figure 4:
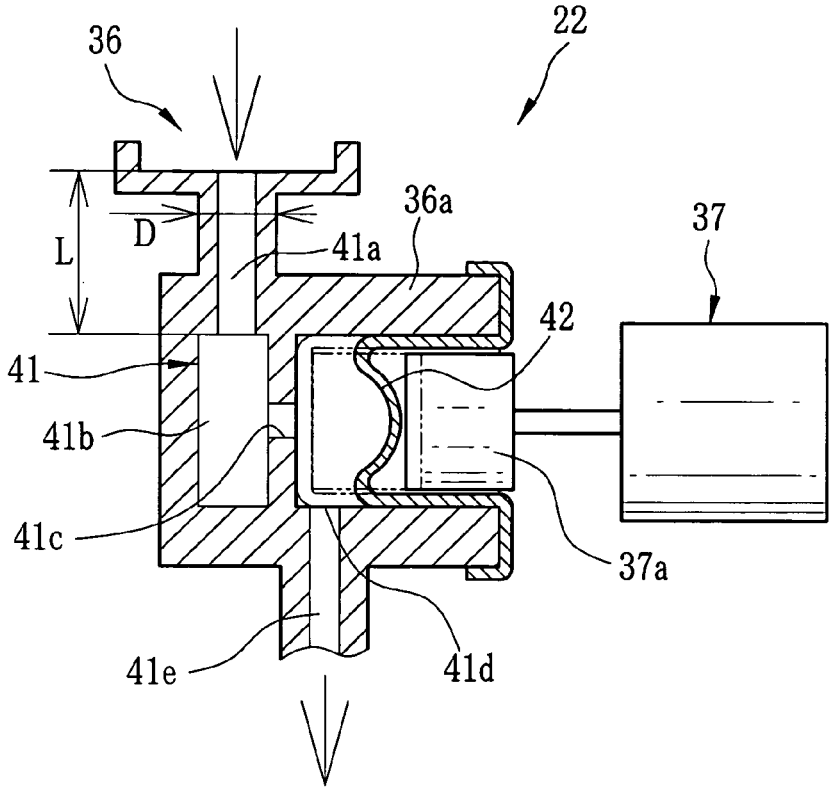
FIG. 4 is a sectional view of a valve unit.
Figure 5:
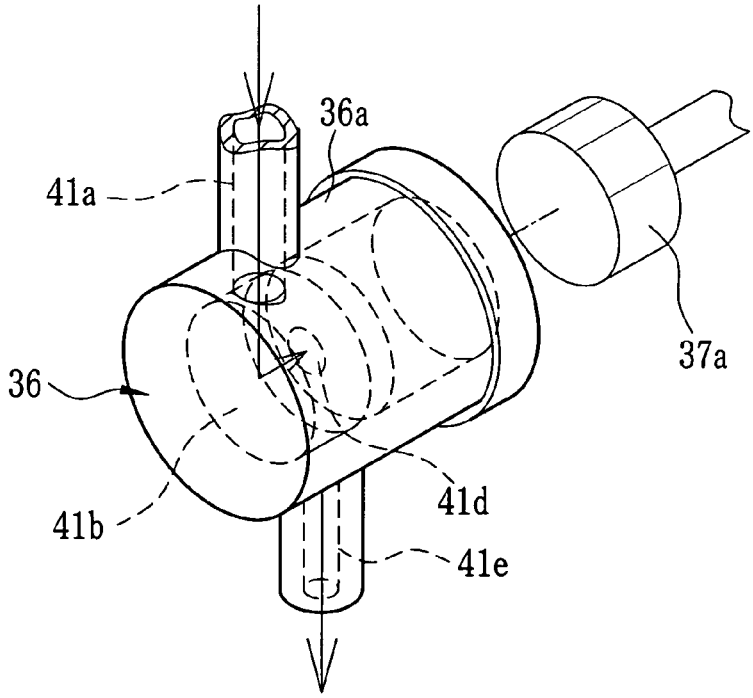
FIG. 5 is an explanatory perspective view of the valve unit.

As shown in FIGS. 4 and 5, the valve unit 22 is placed on the ink supply path from the ink bag 23 to the recording head 12. The valve unit 22 has a valve 42 for opening and closing the ink supply path, and functions as an ink supply amount adjusting device for adjusting the amount of the ink to be supplied to the recording head 12. The valve unit 22 consists of a unit body 36 and an actuator 37 actuating the valve 42. The actuator 37 is mounted to the unit body 36 and is covered with a cover member 38.

The unit body 36 is provided with a flow channel 41 and a cylindrical sleeve 36*a* for mounting the valve 42 that opens or closes the flow channel 41. The flow channel 41 constitutes a part of the ink supply path. An upper end of the flow channel 41 is joined to the ink outlet 26*a*, and a lower end of the flow channel 41 is connected to the recording head 12. The flow channel 41 comprises a tuber inlet channel 41*a*, a round chamber 41*b*, a first opening 41*c* formed through one side of the chamber 41*b*, and a tubular outlet channel 41*e* including a second opening formed perpendicularly to the first opening 41*c*. The inlet channel 41*a* is connected to the case 24, while the outlet channel 41*e* is connected to the recording head 12. The sleeve 36*a* is formed on the side of the first opening 41*c*, and the valve 42 is attached to an open end of the sleeve 36*a*. The sleeve 36*a* accepts a pushing member 37*a* of the actuator 37 so as to be movable therein.

The valve 42 is an elastic film made of rubber or the like, and opens the first and second openings 41*c* and 41*d* in its opening position, as shown by solid lines in FIG. 4, allowing the ink to flow from the first opening 41*c* to the second opening 41*d*. When the pushing member 37*c* of the actuator 37 pushes the valve 42 into the sleeve 36*a*, the valve 42 is elastically deformed to move to its closing position, as shown by phantom lines in FIG. 4. In the closing position, the valve 42 closes the first and second openings 41*c* and 41*d*, thereby to stop the ink flow from the first opening 41*c* to the second opening 41*d*. Thus, the valve 42 opens or closes the flow channel 41. For example, the actuator 37 is constituted of a solenoid, which is not shown but consists of a coil and an iron core, so that the pushing member 37*a* is driven to move back and forth in the sleeve 36*a* by powering the solenoid, to switch over the valve 42.

Figure 6:
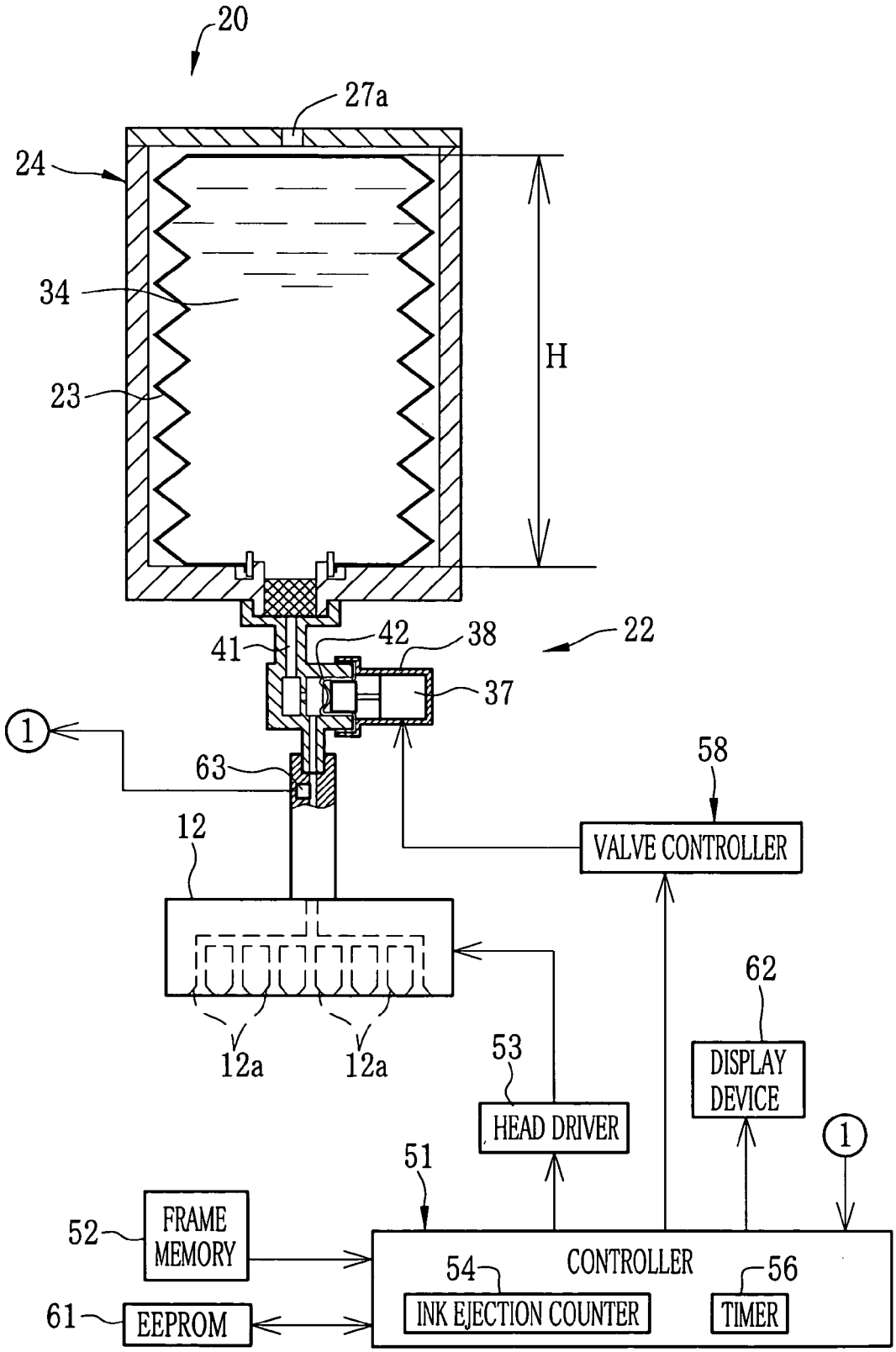
FIG. 6 is a block diagram illustrating the circuitry of an ink supply control system for controlling the valve unit.

As shown in FIG. 6, the flow channel 41 of the valve unit 22 is connected to the recording head 12 by mounting the ink cartridge 20 on the carriage 13. Simultaneously, the actuator 37 is electrically connected to the ink jet recording apparatus 10.

The ink jet recording apparatus 10 controls the valve unit 22 to open or close the flow channel 41. As described later, while the recording head 12 is printing an image, the ink jet recording apparatus 10 opens or closes the valve 42 to supply the ink from the ink bag 23 to the recording head 12 by an amount that is determined in accordance with the discharged amount of ink. That is, the opening time of the valve 42 is controlled according to the discharged amount of ink. Thereby, the head internal pressure is kept substantially constant during the printing, so the stability of ink discharging is ensured, and the ink leakage is prevented during the printing. While the recording head 12 is inactive, i.e. while the recording head 12 is not printing the image, the valve 42 is closed, so the ink is prevented from leaking out of the nozzles 12*a*.

The ink jet recording apparatus 10 has a controller 51. The controller 51 totally controls respective components of the ink jet recording apparatus 10. The controller 51 controls a head driver 53 in accordance with image data read out from a frame memory 52. The head driver 53 drives the recording head 12 to eject the ink through the nozzles 12*a* in accordance with the image data. The controller 51 is provided with an ink ejection counter 54 to count the number of ejections through each of the nozzles 12*a*. The discharged amount of ink is calculated from the count of the ink ejection counter 54 and the size of each droplet ejected from the nozzles 12*a*. The controller 51 functioning as a discharged amount measuring device calculates the discharged ink amount at regular time intervals, while measuring the time by a timer 56.

Instead of measuring the discharged ink amount by calculation based on the number of ink ejections, the controller 51 can measure the discharged ink amount by estimation based on the image data.

A valve controller 58 controls the valve unit 22. In accordance with the discharged amount of ink as calculated by the controller 51, the valve controller 58 calculates an amount of ink to supply to the recording head 12, and controls the opening time of the valve unit 22 so as to supply the ink from the ink bag 23 to the recording head 12 by the calculated amount.

Figure 7:
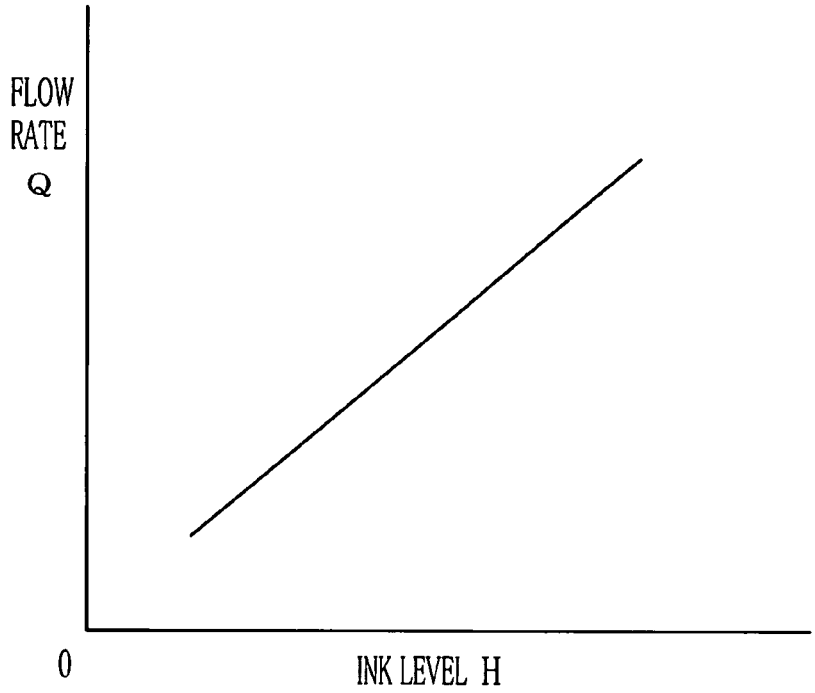
FIG. 7 is a graph illustrating a relationship between flow rate of the ink through an ink supply path and ink level in the ink bag.

The ink 34 flows through the flow channel 41 at a flow rate Q, i.e. a volume of the flown ink per unit time, which is dependent upon a length L and an internal diameter D of the inlet channel 41*a* that provides the maximum flow resistance. Besides that, as shown in FIG. 7, the flow rate Q is proportional to the ink level H in the ink bag 23. Consequently, the flow rate Q may be calculated according to the following formula:

$$Q=\rho\times g\times H\times(\pi\times D^4)/(128\times\mu\times L)$$

wherein ρ represents an ink density, μ represents an ink viscosity, and g represents an acceleration due to gravity.

As seen from the above formula, the flow rate Q decreases as the ink level H gets lower. Accordingly, time for opening the valve 42 to supply the same amount of ink gets longer as the ink level H gets lower. It is found by experiments assuming the ink viscosity μ is constant, that the ink pressure is about 4.5 times greater at the surface height H of 50 mm than at the surface height H of 11 mm. Therefore, when the surface height H is 50 mm, the valve opening time for supplying the same amount of ink is about one-fourth the valve opening time required when the surface height H is 11 mm.

The controller 51 is connected to a non-volatile memory, e.g. EEPROM 61. The EEPROM 61 memorizes the ink level H. During the manufacture, the EEPROM 61 memorizes a maximum value of the ink level H where the ink bag 23 is filled up with the ink. The memorized ink level H is revised at appropriate intervals as the ink is consumed. When the ink level H gets lower than a predetermined value, the controller 51 functioning as an ink level calculator judges that the ink cartridge 20 is running out of the ink 34, and displays a warning on a display device 62, to notice the user of the ink run-out.

Figure 8:
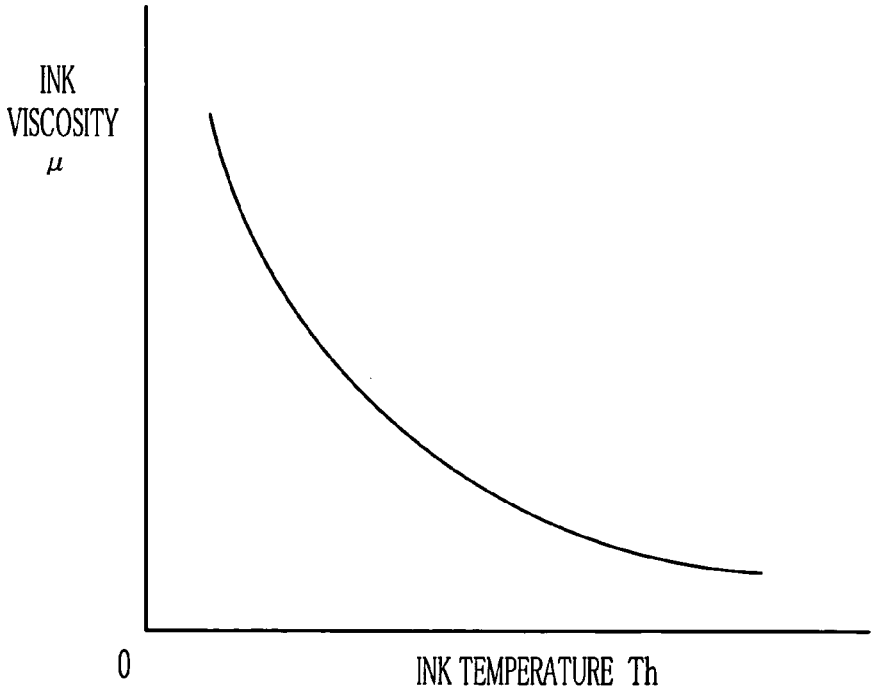
FIG. 8 is a graph illustrating a relationship between the ink temperature and the ink viscosity.

Meanwhile, the ink viscosity μ is detected by measuring the temperature of the ink through a temperature sensor 63. The temperature sensor 63 is placed on the ink supply path in this embodiment. As shown in FIG. 8, the ink viscosity μ gets higher as the ink temperature Th gets lower. According to experiments, when the ink temperature Th falls from 35° C. to 15° C., the ink viscosity μ approximately doubles. As a result, the flow rate Q is reduced by half, so the time for opening the valve 42 to supply the same amount of ink approximately doubles. The valve controller 58 functioning as an ink viscosity calculator reads through the controller 51 the ink temperature as measured by the temperature sensor 63, to calculate the ink viscosity μ.

Applying the ink viscosity μ and the ink level H to the above formula, the valve controller 58 functioning as a flow rate calculator calculates the flow rate Q of the ink through the valve unit 22, and then calculates a time for opening the valve 42 in accordance with the discharged amount of ink. Instead of calculating the flow rate Q based on the above formula, it is possible to determine the flow rate Q with reference to a lookup table stored in a memory.

The head internal pressure is initially adjusted, for example, when the ink jet recording apparatus 10 is powered on. In the initial adjustment of the head internal pressure, the valve 42 is opened up, and the recording head 12 is driven to discharge the ink, while the ink is being supplied from the ink cartridge 20 so as to make the recording head 12 have an adequate internal pressure. For example, the recording head 12 may be provided with an internal pressure sensor for measuring the head internal pressure, so the initial adjustment is made to adjust the value measured by the sensor at a proper value. The head internal pressure is thus adjusted to the proper initial value. The initial value is predetermined in a range where the meniscuses of the nozzles 12*a* are not broken.

As well known in the art, the nozzles can clogged with the ink or air bubbles after the recording head carries out printing for a certain time. The clogged nozzles cause defective discharging of the recording head. To solve the defective discharging, the ink jet recording apparatus is usually provided with a suction cap that is connected to a nozzle smoothing pump. While covering the discharging surface of the recording head with the suction cap, the nozzle smoothing pump is driven to suck out the ink and air bubbles from the nozzles. Therefore, it is possible to execute the initial adjustment of the head internal pressure by sucking the recording head 12 with the suction cap and the nozzle smoothing pump, instead of discharging the ink from the recording head 12.

On sucking with the suction cap, it is possible raise ink velocity through the nozzles 12*a* steeply by opening and closing the valve 42 in synchronism with the sucking. Thereby, the ink and air bubbles, which get jammed in the nozzles 12*a*, are eliminated with reliability. Because the viscosity of the ink as stuffed in the nozzles 12*a* is often increased, a higher suction power is necessary for eliminating the viscous ink. By synchronizing the sucking timing of the nozzle smoothing pump with the timing of opening and closing the valve 42, the suction power can get higher enough for the smoothing.

Since the valve unit 22 is provided, it is possible to close the valve 42 to block the ink supply path during the sucking operation through the suction cap. So the ink contained in the ink bag 23 is not sucked through the suction cap, reducing useless consumption of the ink. Blocking the ink supply path contributes to reducing the sucking pressure necessary for the nozzle smoothing.

Figure 9:
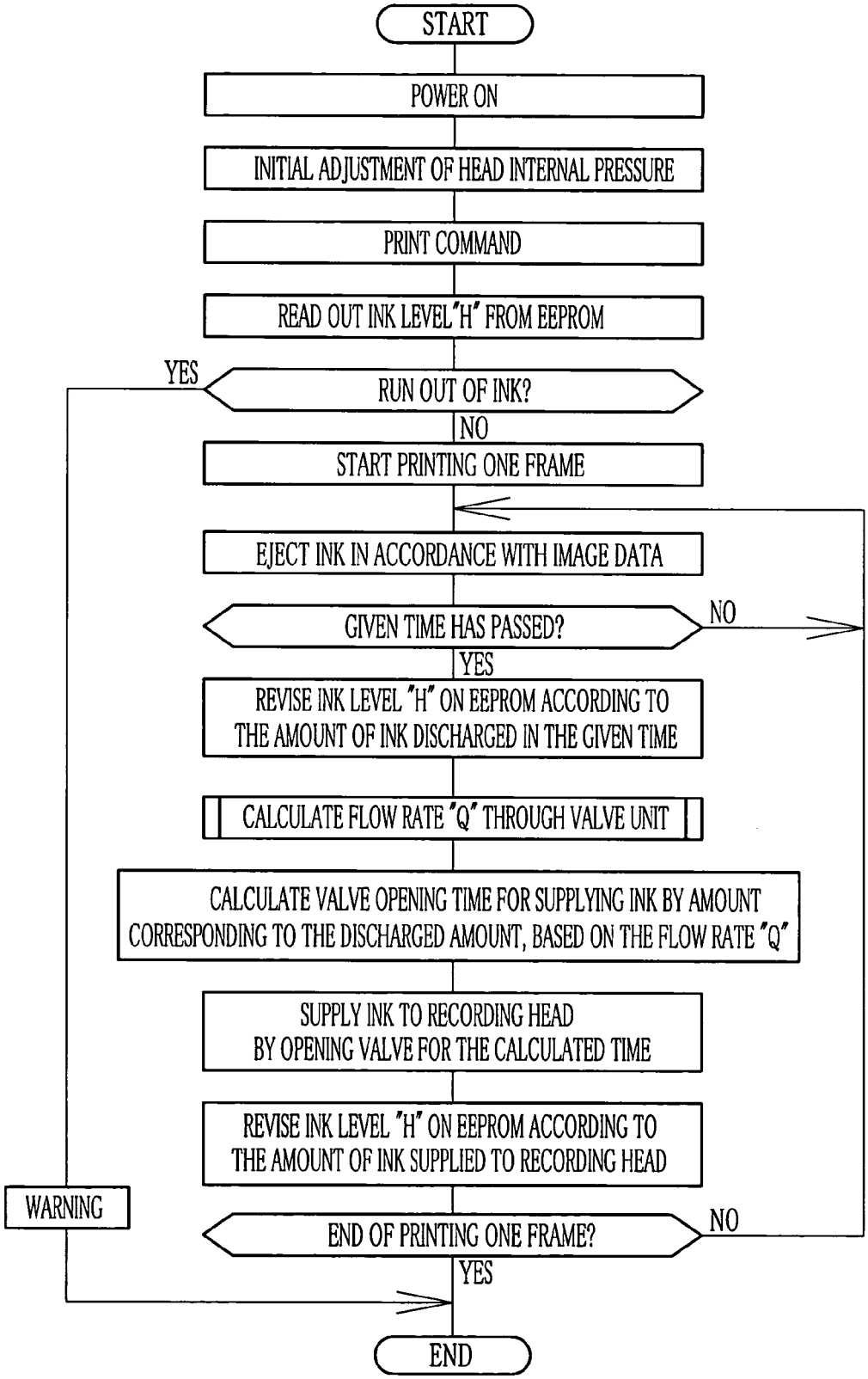
FIG. 9 is a flow chart illustrating a printing sequence of the ink jet recording apparatus.
Figure 10:
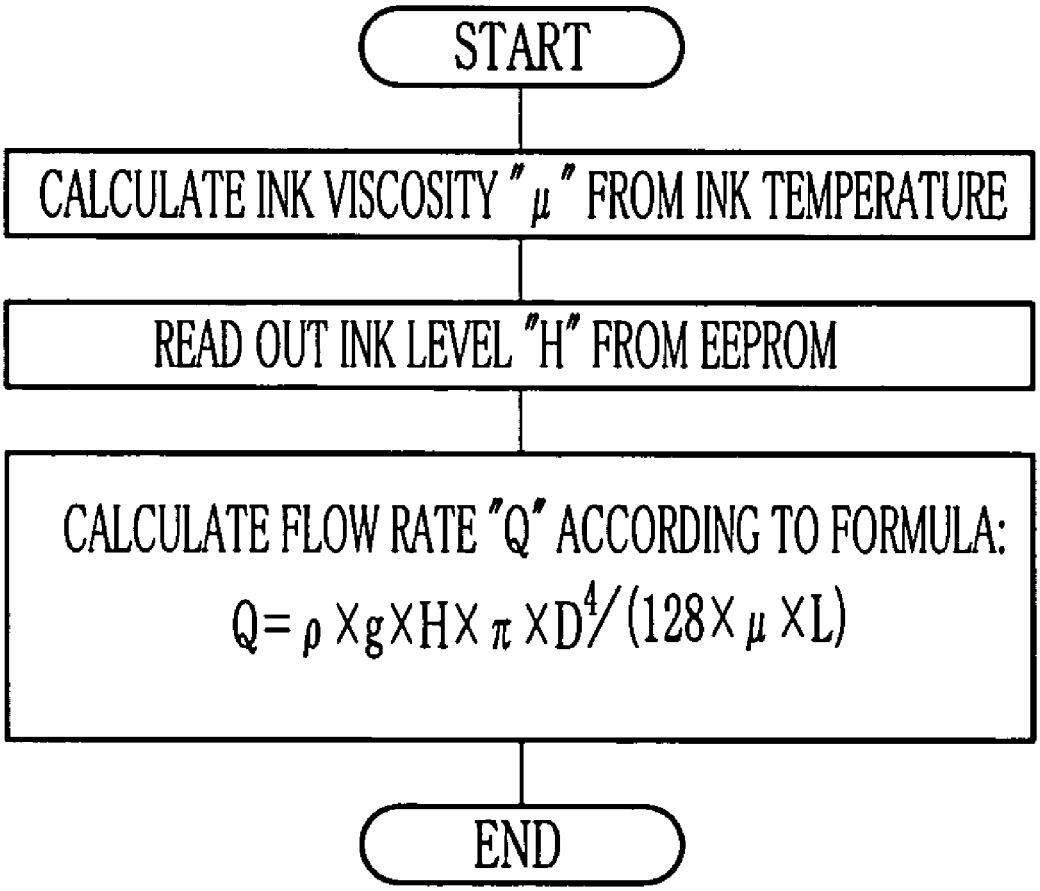
FIG. 10 is a flow chart illustrating a sequence of calculating the flow rate of the ink through the ink supply path.

Now the printing operation of the embodiment shown in FIG. 6 will be described with reference to FIGS. 9 and 10. When the ink jet recording apparatus 10 is powered on, the initial adjustment of the head internal pressure is carried out, thereby to set the head internal pressure at the proper value. Upon a print command, the controller 51 reads out the ink level H from the EEPROM 61. If the ink level H is less than a predetermined level, the controller 51 judges that the ink cartridge 20 is running out of the ink, and gives the warning through the display device 62. If not, the controller 51 stars printing a frame of image. The recording head 12 is driven based on the image data, to eject the ink. Since the head internal pressure is initially adjusted to the proper value, the ink is discharged stably in a first stage of printing.

A given time after the start of discharging the ink, the controller 51 commands the valve controller 58 to start supplying the ink from the ink bag 23 to the recording head 12 in accordance with the discharged amount of ink. Then, the valve controller 58 calculates the flow rate Q of the ink through the flow channel 41. As shown in FIG. 10, the valve controller 58 calculates the ink viscosity μ from the ink temperature Th that is measured by the temperature sensor 63, and reads the ink level H, to calculate the flow rate Q according to the above formula.

Based on the flow rate Q, the valve controller 58 calculates a valve opening time necessary for supplying the ink by the amount calculated by the controller 51. Then the actuator 37 switches the valve 42 to the open position, so the ink flows from the ink bag 23 through the valve unit 22 to the recording head 12. Since the valve 42 is opened for the calculated valve opening time, the ink is supplied to the recording head 12 by the amount corresponding to the amount discharged from the recording head 12. Controlling the amount of the ink supplied to the recording head 12 suppresses variations in the head internal pressure, ensuring the stability of ink discharging operation. While the valve 42 is closed, the ink supply path is blocked, so the positive pressure due to the ink weight does not act on the recording head 12. Accordingly, variations in the head internal pressure are also suppressed As the ink is supplied from the ink bag 23 to the recording head 12, the ink level H comes down. Then the controller 51 revises the memorized ink level H to a reduced value on the EEPROM 61. The sequence as above is cyclically executed till the printing of one frame is accomplished.

Although the ink supply device is constituted of a valve unit that is provided between the ink chamber and the recording head, various modifications of the ink supply device are possible. For example, the valve unit may be mounted in an ink jet recording apparatus, such that the valve unit is connected to an ink cartridge as the ink cartridge is mounted on a carriage. It is also possible to mount a part of a valve unit, e.g. a unit body, to an ink cartridge, while an actuator is mounted in an ink jet recording apparatus.

Although the first embodiment uses the valve unit as the ink supply amount adjusting device, a pump is usable as an ink supply amount adjusting device instead.

As described so far, in order to suppress variations in the head internal pressure, the first embodiment determines the ink level based on the discharged amount of ink from the recording head, calculates from the ink level the flow rate through the ink supply amount adjusting device, and controls the ink supply amount adjusting device to supply the recording head with the ink by an amount corresponding to the discharged ink amount. It is alternatively possible to measure the head internal pressure, and control the ink supply amount adjusting device so as to keep the head internal pressure in a predetermined set value.

Figure 11:
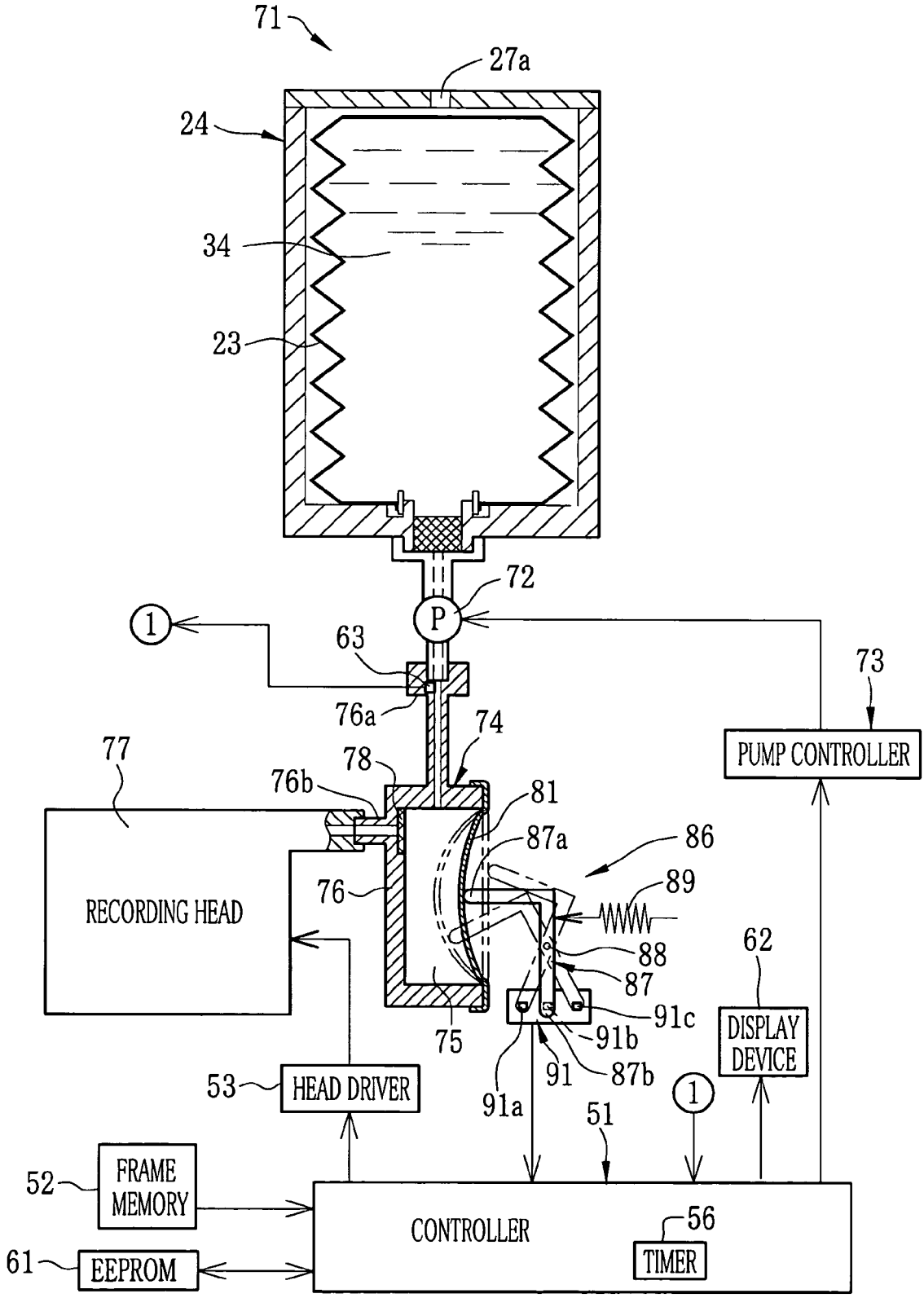
FIG. 11 is an explanatory diagram illustrating another embodiment wherein an ink supply amount adjusting device is controlled based on the head internal pressure detected by use of a sub-tank.

FIG. 11 shows a second embodiment that measures the head internal pressure to control an ink supply amount adjusting device. An ink cartridge 71 is provided with a suction pump 72 as the ink supply amount adjusting device, instead of a valve unit. The suction pump 72 sucks the ink out of the ink bag 23, and sends it forcibly to downstream, so the amount of ink residue in the ink bag 23 is finally reduced. In the following embodiments, equivalent components are designated by the same reference numerals, to avoid redundant description of these components.

A controller 51 controls the suction pump 72 through a pump controller 73. Upon the suction pump 72 being activated, the ink begins to be supplied to a recording head 12. When the suction pump 72 is deactivated, the ink supply is stopped. Therefore, the amount of ink supplied to the recording head 12 is determined by the operation time of the suction pump 72. The suction pump 72 may be mounted to a case 24 of the ink cartridge 71, or may be mounted in an ink jet recording apparatus 10. Where the suction pump 72 is mounted to the ink cartridge 71, the suction pump 72 is preferably a micro pump.

A sub-tank 74 is provided on an ink supply path between the suction pump 72 and the recording head 12. The sub-tank 74 has a tank body 76 in which a temporary storage 75 is formed for storing the ink temporarily on the way from the suction pump 72 to a recording head 77. The tank body 76 is provided with a connecting portion 76*a* for the connection to the suction pump 72, and a connecting portion 76*b* for the connection to the recording head 77. The connecting portion 76*b* is provided with a filter 78 for filtering the ink.

The sub-tank 74 is mounted in an ink jet recording apparatus 10, such that the sub-tank 74 is connected to the suction pump 72 as the ink cartridge 71 is loaded in the ink jet recording apparatus 10. But it is possible to mount the sub-tank 74 to the ink cartridge 71.

An elastic film 81 is attached to an open side of the tank body 76, such that the elastic film 81 tightly closes the temporary storage 75. The elastic film 81 makes the volume of the temporary storage 75 variable according to variations in internal pressure of the recording head 77. The elastic film 81 may be formed by laminating a thin film on an elastic material, or by combining a thin film with a compressed spring.

The ink from the suction pump 72 is supplied through the sub-tank 74 to the recording head 77. As the ink is temporarily stored in the sub-tank 74, the ink flows moderately into the recording head 77, so the variations in head internal pressure are still more suppressed. Therefore, the stability of ink discharging is still more improved. Since the ink is prevented from flowing sharply into the recording head 77, it is easy to suppress the amplitude of variation in the head internal pressure in a certain range, even with rough control of the ink supply amount through the suction pump 72.

According to the present embodiment, a head internal pressure detecting mechanism 86 is mounted in the ink jet recording apparatus 10. The head internal pressure detecting mechanism 86 is a head internal pressure measuring device, and detects by an amount of deformation of the elastic film 81 whether the head internal pressure is at the set value. According to the head internal pressure detected by the head internal pressure detecting mechanism 86, the controller 51 controls the suction pump 72 so as to adjust the head internal pressure to the set value. The head internal pressure detecting mechanism 86 consists of an L-shaped swinging arm 87 that swings about a rotary center 88, a spring 89 and a photo sensor 91. The spring 89 urges the swinging arm 87 in a direction to press one end 87*a* of the swinging arm 87 on the elastic film 81. The photo sensor 91 detects the position of a second end 87*b* of the swinging arm 87.

When the head internal pressure is high, pressure inside the temporary storage 75, hereinafter called the sub-tank pressure, gets high, so the elastic film 81 deforms to swell out. On the contrary, when the head internal pressure is low, the sub-tank pressure gets low, so the elastic film 81 deforms to dent in. Since the spring 89 presses the swinging arm 87 onto the elastic film 81, the swinging arm 87 swings according the deformation of the elastic film 81. The photo sensor 91 has a number of sensor elements, e.g. three sensor elements 91*a*, 91*b* and 91*c*, arranged along the track of movement of the second end 87*b* of the swinging arm 87. When the second end 87*b* is opposed to one of the sensor elements 91*a* to 91*c*, the one sensor element 91*a*, 91*b* or 91*c* outputs a detection signal to the controller 51.

The controller 51 judges by the detection signal from the photo sensor 91 whether the head internal pressure is at the set value, or lower or higher than the set value. For example, it is predetermined that when the head internal pressure is at the set value, the elastic film 81 and thus the swinging arm 87 are in a condition shown by solid lines in FIG. 11, so the controller 51 receives the detection signal from the sensor element 91*b*.

Figure 12:
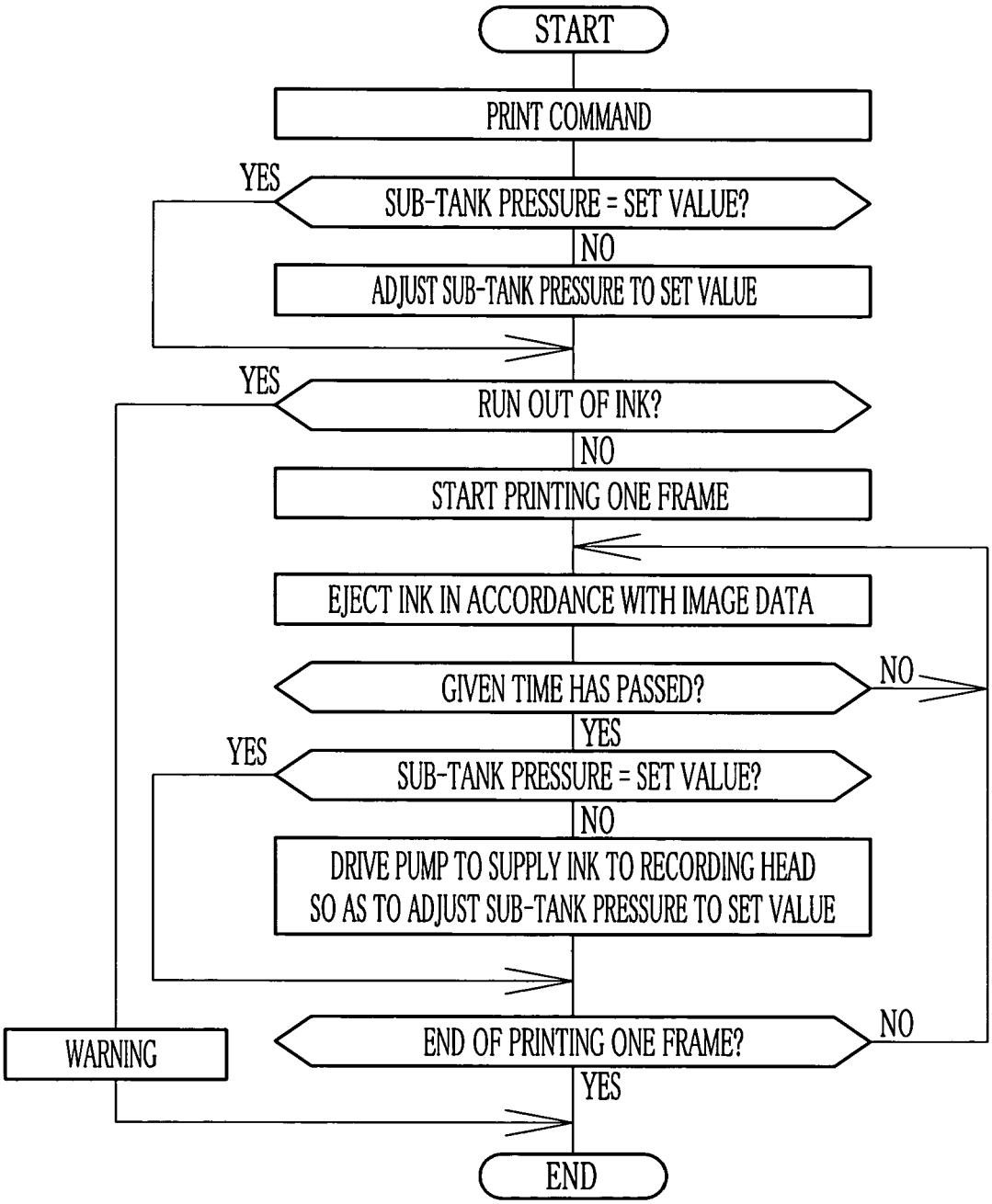
FIG. 12 is a flow chart illustrating a printing sequence of an ink jet recording apparatus according to the second embodiment shown in FIG. 11.

FIG. 12 shows a printing sequence of the second embodiment. First, the controller 51 detects the sub-tank pressure to make the initial adjustment of the head internal pressure. When the sub-tank pressure is higher than the set value, that is, when the controller 51 receives the detection signal from the sensor element 91*a*, the recording head 77 discharges some ink to lower the head internal pressure down to the set value. On the contrary, when the sub-tank pressure is lower than the set value, that is, when the controller 51 receives the detection signal from the sensor element 91*c*, the suction pump 72 is driven to supply the ink to the sub-tank 74 and the recording head 77, to raise the head internal pressure up to the set value.

After the initial adjustment of the head internal pressure, the controller 51 starts processing for printing. During the printing, the controller 51 checks the sub-tank pressure at predetermined time intervals. With an ejection of the ink, the head internal pressure goes down, so the sub-tank pressure gets lower than the set value. In this way, the head internal pressure is adjusted to the set value, suppressing variations in the head internal pressure.

Although the sub-tank 74 of the present embodiment is made partly elastic to permit changing the volume of the temporary storage 75, it is possible to form the whole sub-tank from an elastic material.

Figure 13:
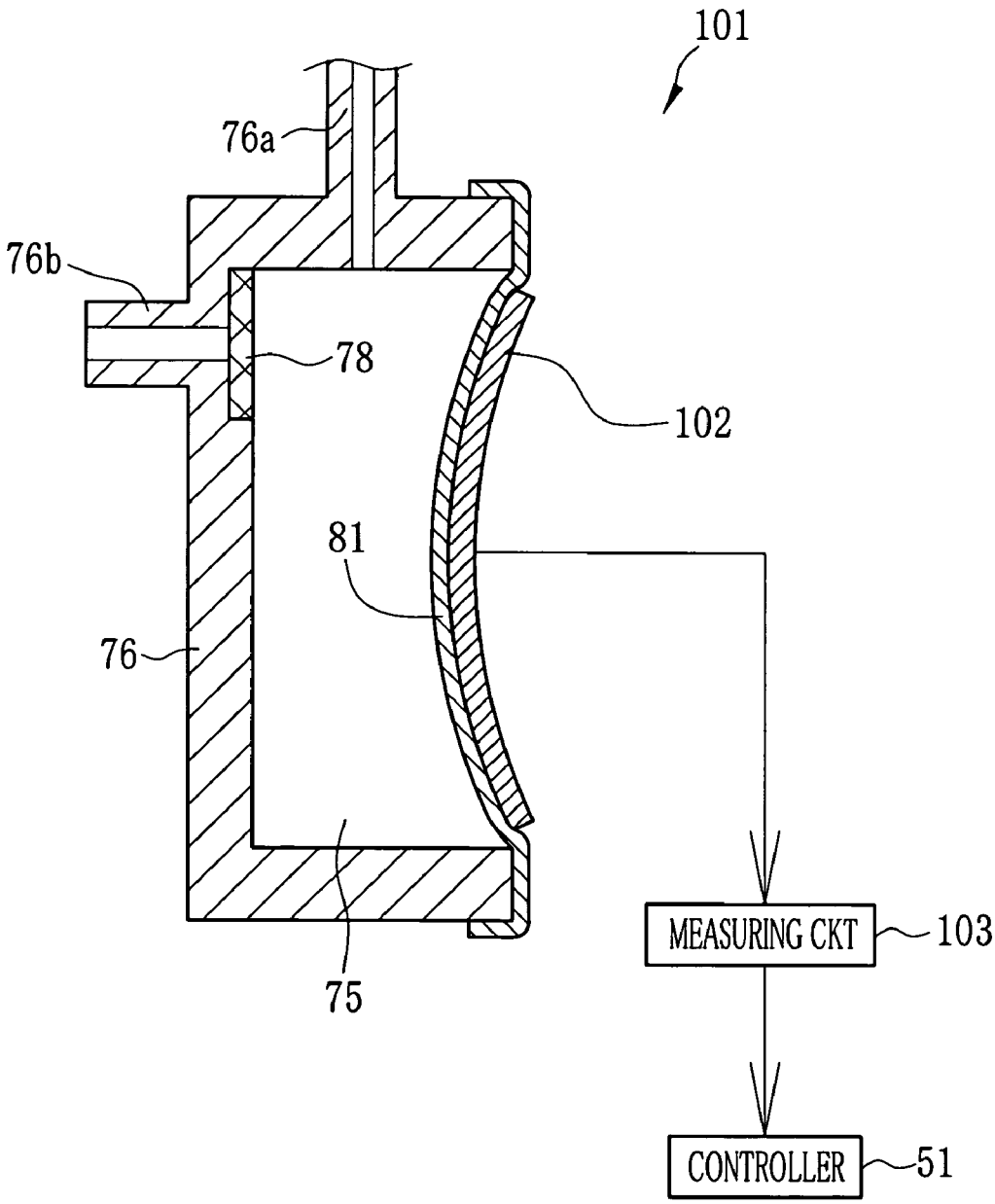
FIG. 13 is a sectional view of a sub-tank that detects the head internal pressure through a distortion sensor.

Instead of the head internal pressure detecting mechanism 86, a distortion sensor 102 is usable as a head internal pressure measuring device, as shown in a sub-tank 101 of FIG. 13. The distortion sensor 102 is affixed to an external surface of an elastic film 81, and changes its resistance according to the deformation of the elastic film 81. A measuring circuit 103 outputs a signal corresponding to the change in resistance of the distortion sensor 102. Based on the signal from the measuring circuit 103, a controller 51 detects the head internal pressure. The distortion sensor 102 permits detecting the change in the head internal pressure as a continuous curve, so the head internal pressure may be adjusted with higher accuracy.

As another head internal pressure measuring device, a pressure sensor is usable for measuring the internal pressure of the sub-tank or the recording head.

Figure 14:
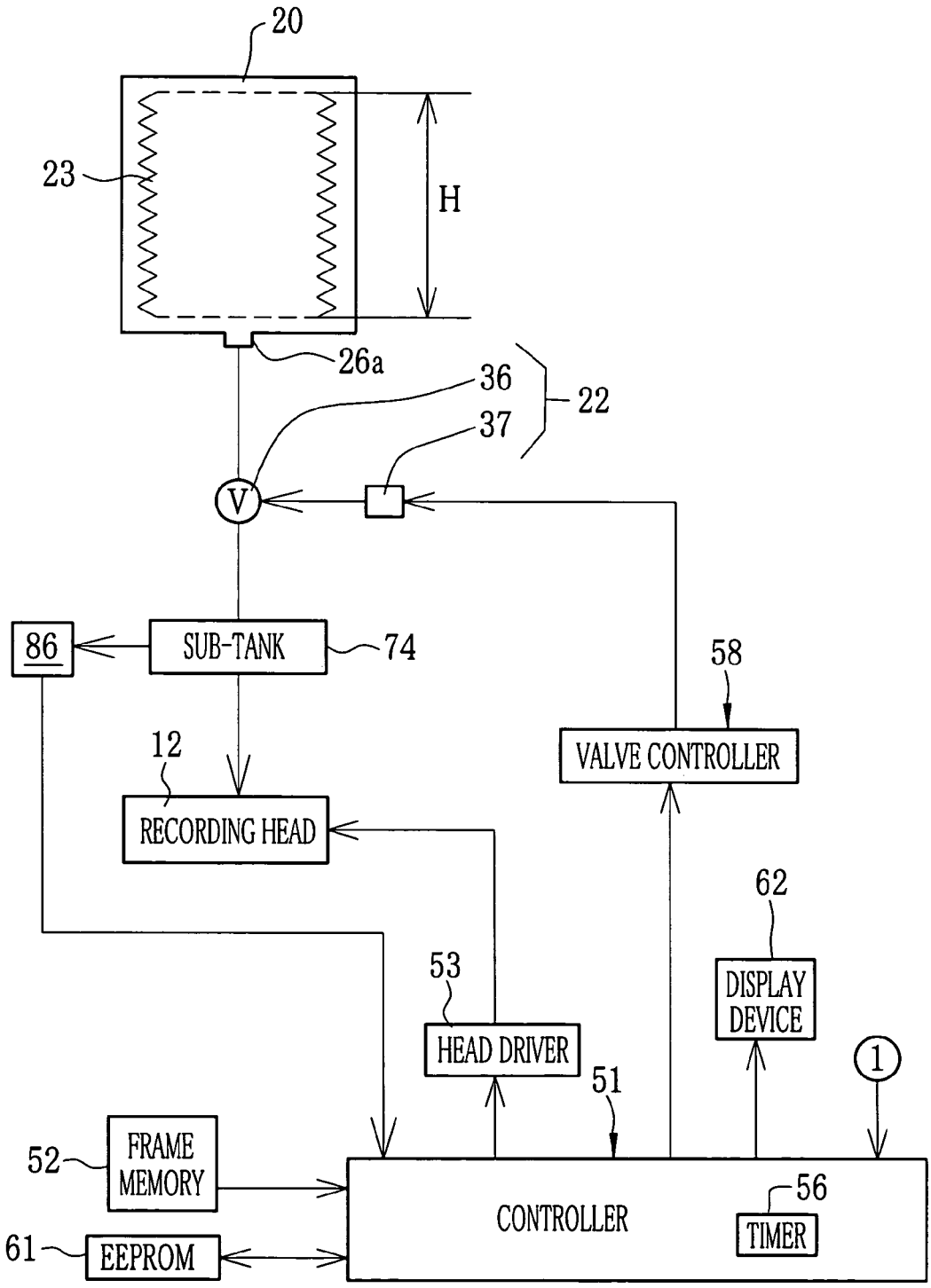
FIG. 14 is an explanatory diagram illustrating a third embodiment using the valve unit and the sub-tank in combination.
Figure 15:
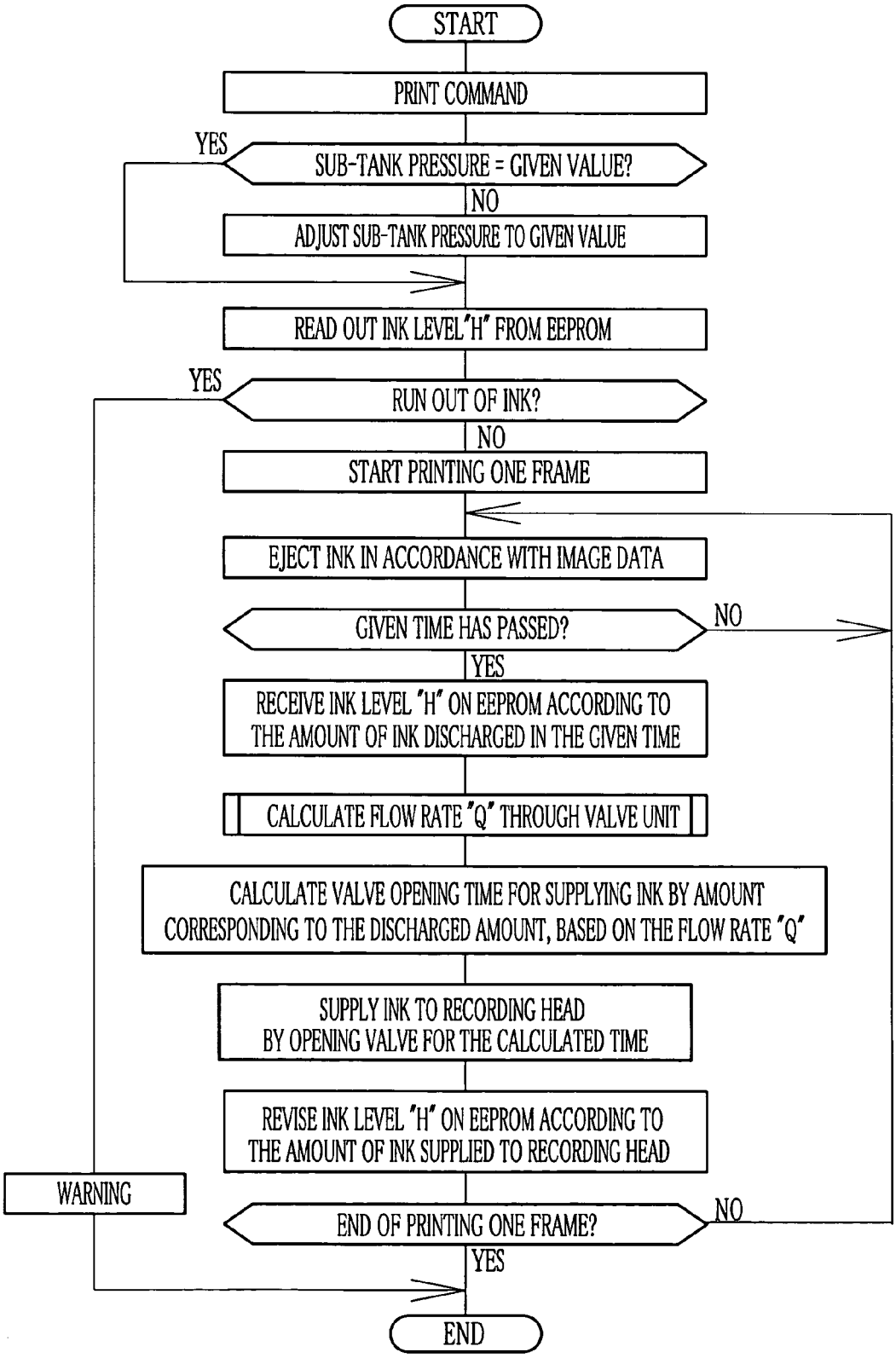
FIG. 15 is a flow chart illustrating a printing sequence of an ink jet recording apparatus according to the third embodiment shown in FIG. 14.

According to a third embodiment shown in FIG. 14, a head internal pressure detecting mechanism 86 is used merely for the initial adjustment of the head internal pressure. In order to adjust the head internal pressure during the printing, a valve unit 22 is controlled as an ink supply amount adjusting device to supply the ink to a recording head 12 in accordance with the discharged amount of ink. As shown in FIG. 15, first the head internal pressure detecting mechanism 86 detects the sub-tank pressure, and carries out the initial adjustment of the head internal pressure. After the start of printing, the discharged amount of ink is measured for example by estimation based on the image data, and the ink level H is detected based on the discharged ink amount. Taking account of the ink level H, a controller 51 calculates the flow rate Q through the valve unit 22, and controls the valve opening time of the valve unit 22 based on the flow rate Q, so as to supply the recording head 12 with the ink by an amount corresponding to the discharged amount. Thereby, variations in the head internal pressure are suppressed.

Although the present invention has been described with respect to the embodiment wherein the ink cartridges are removably connected to the recording head, the present invention is applicable to an ink cartridge where a recording head is integrated with an ink container, or an ink container fixedly mounted in an ink jet recording apparatus.

Thus the present invention is not to be limited to the above-described embodiments, but various modifications will be possible without departing from the scope of claims as appended hereto.

What is claimed is:

1. An ink supply device used in an ink jet recording apparatus, for supplying ink to a recording head that discharges the ink from nozzles to record an image, said ink supply device comprising:

an ink container consisting of an ink bag storing the ink and a case for holding said ink bag, said ink container being placed above said recording head;

an ink supply amount adjusting device for adjusting the amount of ink supplied to said recording head, said ink supply amount adjusting device being placed on an ink supply path from said ink bag to said recording head;

a discharged amount measuring device for measuring the amount of ink discharged from said recording head; and a controller for controlling said ink supply amount adjusting device so as to supply said recording head with the ink by an amount corresponding to the discharged amount of ink as measured by said discharged amount measuring device, and wherein said controller comprises an ink level calculator for calculating an ink level in said ink bag based on the discharged ink amount, and a flow rate calculator for calculating based on the calculated ink level a flow rate per unit time of the ink through said ink supply path, to control said ink supply amount adjusting device based on the flow rate.

2. An ink supply device as claimed in claim 1, wherein said discharged amount measuring device measures the discharged ink amount by counting the number of ink ejections from said recording head.

3. An ink supply device as claimed in claim 1, wherein said discharged amount measuring device measures the discharged ink amount by estimation based on the image data.

4. An ink supply device as claimed in claim 1, further comprising a temperature sensor for measuring temperature of the ink, and an ink viscosity calculator for calculating a viscosity of the ink based on the measured ink temperature, wherein said flow rate calculator calculates the flow rate taking account of the ink viscosity.

5. An ink supply device as claimed in claim 1, wherein said ink bag has accordion folds that extend substantially horizontally, so that said ink bag is folded down along said accordion folds as the ink in said ink bag decreases.

6. An ink supply device as claimed in claim 1, wherein said ink supply amount adjusting device comprises a valve unit that opens or closes said ink supply path.

7. An ink supply device as claimed in claim 1, wherein said ink supply amount adjusting device comprises a pump that sucks the ink out of said ink bag and sends the ink forcibly to said recording head.

8. An ink supply device as claimed in claim 1, wherein said ink container is removably connected to said recording head, which is built in said ink jet recording apparatus.

9. An ink supply device used in an ink jet recording apparatus, for supplying ink to a recording head that discharges ink through nozzles to record an image, said ink supply device comprising:

an ink container consisting of an ink bag storing the ink and a case for holding said ink bag, said ink container being placed above said recording head;

an ink supply amount adjusting device for adjusting the amount of ink supplied to said recording head, said ink supply amount adjusting device being placed on an ink supply path from said ink bag to said recording head;

a head internal pressure measuring device for measuring pressure inside said recording head; and a controller for controlling said ink supply amount adjusting device in accordance with the pressure measured by said head internal pressure measuring device, and wherein said controller comprises an ink level calculator for calculating an ink level in said ink bag based on the discharged ink amount, and a flow rate calculator for calculating based on the calculated ink level a flow rate per unit time of the ink through said ink supply path, to control said ink supply amount adjusting device based on the flow rate.

10. An ink supply device as claimed in claim 9, further comprising a sub-tank placed on said ink supply path between said ink supply amount adjusting device and said recording head, wherein said sub-tank has a storage section for storing the ink temporarily on the way to said recording head, and is made at least partly of an elastic member that can deform elastically such that said storage section changes its volume as the pressure inside said recording head varies.

11. An ink supply device as claimed in claim 10, wherein said head internal pressure measuring device is a mechanism for detecting based on the degree of deformation of said elastic member whether the pressure inside said recording head is at a set value or not.

12. An ink supply device as claimed in claim 9, wherein said ink bag has accordion folds that extend substantially horizontally, so that said ink bag is folded down along said accordion folds as the ink in said ink bag decreases.

13. An ink supply device as claimed in claim 9, wherein said ink supply amount adjusting device is a valve unit that opens or closes said ink supply path.

14. An ink supply device as claimed in claim 9, wherein said ink supply amount adjusting device is a pump that sucks the ink out of said ink bag and sends the ink forcibly to said recording head.

15. An ink supply device as claimed in claim 9, wherein said ink container is removably connected to said recording head, which is built in said ink jet recording apparatus.

16. An ink jet recording apparatus as claimed in claim 9, wherein said controller controls said ink supply amount adjusting device so as to keep the pressure inside said recording head at a set value.

17. An ink supply device as claimed in claim 9, further comprising a discharged amount measuring device for measuring the amount of ink discharged from said recording head at predetermined time internals while said recording head is recording an image, wherein said controller controls said ink supply amount adjusting device so as to supply said recording head with the ink by an amount corresponding to the discharged amount of ink as measured by said discharged amount measuring device.

18. An ink jet recording apparatus for recording an image by discharging ink from a recording head, wherein said recording head is supplied with ink from an ink container that is placed above said recording head, and consists of an ink bag storing the ink and a case for holding said ink bag, said ink jet recording apparatus comprising:

an ink supply amount adjusting device for adjusting the amount of ink supplied to said recording head, said ink supply amount adjusting device being placed on an ink supply path from said ink bag to said recording head;

a discharged amount measuring device for measuring the amount of ink discharged from said recording head; and a controller for controlling said ink supply amount adjusting device so as to supply said recording head with the ink by an amount corresponding to the discharged amount of ink as measured by said discharged amount measuring device, and wherein said controller comprises an ink level calculator for calculating an ink level in said ink bag based on the discharged ink amount, and a flow rate calculator for calculating based on the calculated ink level a flow rate per unit time of the ink through said ink supply path, to control said ink supply amount adjusting device based on the flow rate.

19. An ink jet recording apparatus as claimed in claim 18, further comprising a temperature sensor for measuring temperature of the ink, and an ink viscosity calculator for calculating a viscosity of the ink based on the measured ink temperature, wherein said flow rate calculator calculates the flow rate taking account of the ink viscosity.

20. An ink jet recording apparatus having a recording head that discharges ink through nozzles to record an image, said ink jet recording apparatus comprising:

an ink container consisting of an ink bag storing the ink and a case for holding said ink bag, said ink container being placed above said recording head;

an ink supply amount adjusting device for adjusting the amount of ink supplied to said recording head, said ink supply amount adjusting device being placed on an ink supply path from said ink bag to said recording head;

a head internal pressure measuring device for measuring pressure inside said recording head; and a controller for controlling said ink supply amount adjusting device in accordance with the pressure measured by said head internal pressure measuring device, and wherein said controller comprises an ink level calculator for calculating an ink level in said ink bag based on the discharged ink amount, and a flow rate calculator for calculating based on the calculated ink level a flow rate per unit time of the ink through said ink supply path, to control said ink supply amount adjusting device based on the flow rate.

* * * * *